US008235584B2

(12) United States Patent
Wyssbrod

(10) Patent No.: US 8,235,584 B2
(45) Date of Patent: Aug. 7, 2012

(54) CHRONOGRAPH CONTROL DEVICE

(75) Inventor: Baptist Wyssbrod, Nidau (CH)

(73) Assignee: Omega S.A., Bienne (CH)

( * ) Notice: Subject to any disclaimer, the term of this patent is extended or adjusted under 35 U.S.C. 154(b) by 420 days.

(21) Appl. No.: 12/330,067

(22) Filed: Dec. 8, 2008

(65) Prior Publication Data

US 2009/0147629 A1 Jun. 11, 2009

(30) Foreign Application Priority Data

Dec. 7, 2007 (EP) ..... 07122635

(51) Int. Cl.
*G04F 7/00* (2006.01)

(52) U.S. Cl. ..... 368/103; 368/101

(58) Field of Classification Search ..... 368/101–106, 368/110–112
See application file for complete search history.

(56) References Cited

U.S. PATENT DOCUMENTS

| | | | | | |
|---|---|---|---|---|---|
| 2,671,308 | A | * | 3/1954 | Ciana | 368/103 |
| 3,495,397 | A | * | 2/1970 | Dubois | 368/106 |
| 3,633,354 | A | * | 1/1972 | Stemmler | 368/27 |
| 3,780,525 | A | * | 12/1973 | Kitai | 368/222 |
| 3,817,024 | A | * | 6/1974 | Noguchi | 368/185 |
| 3,824,782 | A | * | 7/1974 | Iinuma | 368/185 |
| 3,842,591 | A | * | 10/1974 | Dubois et al. | 368/104 |
| 4,364,674 | A | * | 12/1982 | Tesch | 368/319 |
| 4,408,896 | A | * | 10/1983 | Ikegami | 368/185 |
| 4,922,474 | A | * | 5/1990 | Groothuis | 368/113 |
| 5,042,016 | A | * | 8/1991 | Suzuki et al. | 368/74 |
| 5,113,382 | A | | 5/1992 | Bron | |
| 5,214,625 | A | * | 5/1993 | Suzuki et al. | 368/192 |
| 5,793,708 | A | | 8/1998 | Schmidt et al. | |
| 2009/0034373 | A1 | * | 2/2009 | Journe | 368/106 |

FOREIGN PATENT DOCUMENTS

| | | |
|---|---|---|
| EP | 0 451 660 A1 | 10/1991 |
| EP | 0 772 104 A1 | 5/1997 |
| GB | 698 763 | 10/1953 |

OTHER PUBLICATIONS

European Search Report issued in corresponding application No. EP 07 12 2635, completed Aug. 12, 2008.

* cited by examiner

*Primary Examiner* — Sean Kayes
(74) *Attorney, Agent, or Firm* — Griffin & Szipl, P.C.

(57) ABSTRACT

The present invention concerns a chronograph control device including a first, pivotably mounted lever, which is activated by a first push-button and whose movement in the direction of the first push-button is limited by a first stop member, and a second, pivotably mounted lever, which is activated by a second push-button and whose movement is limited in the direction of the second push-button by a second stop member. A spring is mounted on the second lever. The first lever is associated with an arm, provided with a beak. The beak cooperates with the spring such that, when one or other of the two levers is activated by one of the push-buttons, the beak and the spring move relative to each other in such a way that the beak is subjected to the return force of the spring.

9 Claims, 2 Drawing Sheets

CHRONOGRAPH CONTROL DEVICE

This application claims priority from European Patent Application No. EP 07122635.1 filed Dec. 7, 2007, the entire disclosure of which is incorporated herein by reference.

FIELD OF THE INVENTION

The present invention concerns a chronograph control device. More specifically, it concerns a device of this type for a chronograph that has at least two push-buttons.

The invention applies in particular to "two time" chronographs, which have two push-buttons, in this case a first push-button, which starts and stops a chronograph mechanism and a second push-button, which resets a counter and controls a display member, such as a hand.

BACKGROUND OF THE INVENTION

Designers wish to ensure that the feeling of resistance felt when a first push-button is activated remains constant compared to the resistance felt when a second push-button is activated and, in a preferred identical mode, while keeping the functions of the two push-buttons independent. This is not always the case for known chronographs, particularly when one of the push-buttons is activated more often than the other. For many applications, equal resistance for both push-buttons is also desired, i.e. one wishes the user to feel the same resistance both when he activates the start/stop push-button and when he activates the reset push-button. Moreover, it is sought to make the functions of the two push-buttons completely independent of each other.

A chronograph control device is known, in particular, from GB Patent No. 698 763. This document discloses a chronograph mechanism including two push-buttons, each cooperating with a pivotably mounted lever. The first lever cooperates with the second so as to make the second lever pivot when the first lever is driven in rotation. A spring abuts on a stud secured to the second lever, so as to stop the lever against the second push-button. When the second lever is pivoted via the action of the push-button, it is subjected to the return force of the spring, whereas the first lever is subjected to this return force indirectly, via the second lever. One drawback of this mechanism is the interdependence of the two push-buttons.

It is thus an object of the invention to overcome this drawback and to provide users with a chronograph control device that meets the requirements explained above.

SUMMARY OF THE INVENTION

The invention therefore concerns a chronograph control device, according to a first non-limiting illustrative embodiment, wherein the chronograph control device includes: (a) a first, pivotably mounted lever, which is activated by a first push-button, and whose movement in the direction of the first push-button is limited by a first stop member, (b) a second, pivotably mounted lever, which is activated by a second push-button, and whose movement in the direction of the second push-button is limited by a second stop member, and (c) a spring mounted on the second lever, wherein the first lever is associated with an arm that cooperates with the spring such that, when one or other of the two levers is activated by one of the push-buttons, the arm and the spring move relative to each other in such a way that the arm is subjected to the return force of the spring. This device includes a first, pivotably mounted lever, which is activated by a first push-button, and whose movement is limited in the direction of the first push-button by a first stop member, and a second, pivotably mounted lever, which is activated by a second push-button, and whose movement is limited in the direction of the second push-button by a second stop member. A spring is fixedly mounted on the second lever.

According to the invention, the first lever is associated with an arm that cooperates with the spring such that, when one or other of the two levers is activated by one of the push-buttons, the arm and the spring move in relation to each other in such a way that the arm is still subjected to the return force of the spring. The return force of the spring and the geometry of the mechanism, namely the length of the lever arms involved, thus determine the resistance that the user feels when he activates one of the push-buttons. If the return force of the spring decreases over time, the resistance felt when one of the two push-buttons is activated will decrease such that the ratio of these two resistances to each other always remains constant. The force felt when the push-button is activated also depends, of course, upon the friction between the elements. Since the friction is low compared to the return force of the spring, it will be ignored hereafter.

The arm can be provided with a beak and may cooperate with the spring via the beak. It is also possible to provide the arm with a pin or peg, so that the arm cooperates with the spring via the pin or peg. This variant enables an arm and a spring, which are not in the same plane, to cooperate with each other, which is particularly advantageous when the two levers are not in the same plane.

According to one embodiment of the invention, the arm is integral with the first lever, and the first lever pivots in an opposite direction of rotation to the second lever. This embodiment has the advantage of being simple, which facilitates assembly of the device and thus assembly of the chronograph.

It is clear that numerous variants of this first embodiment could be envisaged, all of these variants falling within the field of protection of the illustrative embodiment identified above. The arm and the spring could, in theory, cooperate with each other via any type of intermediate part. The spring could, of course, take the form of any type of elastic element. It could be a jumper spring, but it is also possible to use an elastic element attached to the second lever, in particular an extended portion, connected to the lever by an elastic section.

For a device of this type, wherein the arm is integral with the first lever, which pivots in the opposite direction of rotation to the second lever, it is particularly advantageous to select the geometry of the device such that the distance between the pivoting axis of the first lever and the direction of the force exerted on the push-button, when the latter is activated, is equal to the distance between the pivoting axis of the second lever and the direction of the force exerted on the second push-button, when the latter is activated. In such case, the resistance felt when the first push-button is activated is equal to the resistance felt when the second push-button is activated. This resistance depends only on the return force of the spring and the aforecited distances, and friction, which will be ignored as stated above. Given that, when either one of the two push-buttons is activated, the beak and the spring move in relation to each other such that the beak is always subjected to the return force of the spring, the ratio of resistance felt depends only upon the ratio of the lever arms involved, and thus on the ratio between, on the one hand, the distance between the pivoting axis of the first lever and the direction of force exerted on the first push-button, and, on the other hand, the distance between the pivoting axis of the second lever and the direction of force exerted on the second push-button.

According to a second embodiment, the arm is pivotably mounted and articulated on the end of the first lever. The first lever pivots in the same direction of rotation as the second lever, and the arm pivots in the opposite direction of rotation to the two levers. Preferably, the arm is articulated on the second lever and pivots about the same axis as the second lever.

If one wishes the resistance felt by the user when one of the push-buttons is activated to be the same for both push-buttons, the geometry of the mechanism could be sized accordingly. One could, for example, alter the ratio of moments necessary for activating a push-button and thus alter the ratio of resistance felt, by changing the length of the lever arms involved.

According to a particularly advantageous embodiment, the first and/or the second stop member is formed by the corresponding push-button.

Thus, in accordance with a second non-limiting illustrative embodiment of the present invention, the first non-limiting illustrative embodiment is modified so that the arm is provided with a beak that cooperates with the spring. In accordance with a third non-limiting illustrative embodiment of the present invention, the first non-limiting illustrative embodiment is modified so that the arm is provided with a pin or peg that cooperates with the spring. In accordance with a fourth non-limiting illustrative embodiment of the present invention, the first non-limiting illustrative embodiment is modified so that the arm is attached to the first lever and wherein the first lever pivots in an opposite direction of rotation to that of the second lever. In accordance with a fifth non-limiting illustrative embodiment of the present invention, the fourth non-limiting illustrative embodiment is further modified so that the distance between the pivoting axis of the first lever and the direction of the force exerted on the first push-button when the push-button is activated, is equal to the distance between the pivoting axis of the second lever and the direction of the force exerted on the second push-button, when the push-button is activated.

In accordance with a sixth non-limiting illustrative embodiment of the present invention, the first non-limiting illustrative embodiment is modified so that the arm is pivotably mounted and articulated on the end of the first lever, wherein the first lever pivots in the same direction of rotation as the second lever and the arm pivots in the opposite direction of rotation to the two levers. In accordance with a seventh non-limiting illustrative embodiment of the present invention, the first non-limiting illustrative embodiment is modified so that the arm is articulated on the second lever and pivots about the same axis as the second lever. In accordance with an eighth non-limiting illustrative embodiment of the present invention, the first non-limiting illustrative embodiment is modified so that the first stop member and/or second stop member is formed by the corresponding push-button. In accordance with a ninth non-limiting illustrative embodiment of the present invention, the first non-limiting illustrative embodiment is modified so that the spring is a jumper spring.

BRIEF DESCRIPTION OF THE DRAWINGS

The invention will become clearer upon reading the following description of two preferred embodiments, given by way of non-limiting example, and referring to the annexed drawings, in which.

DETAILED DESCRIPTION OF THE PREFERRED EMBODIMENTS

Figure 1:
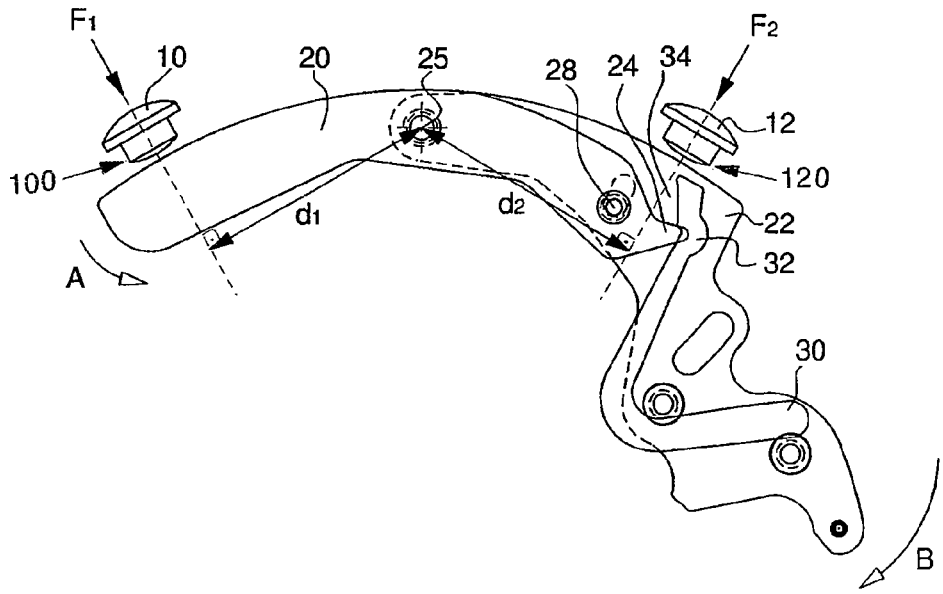
FIG. 1 shows a view of a chronograph control device, seen from the gear train side, according to a first embodiment of the invention.
Figure 3:
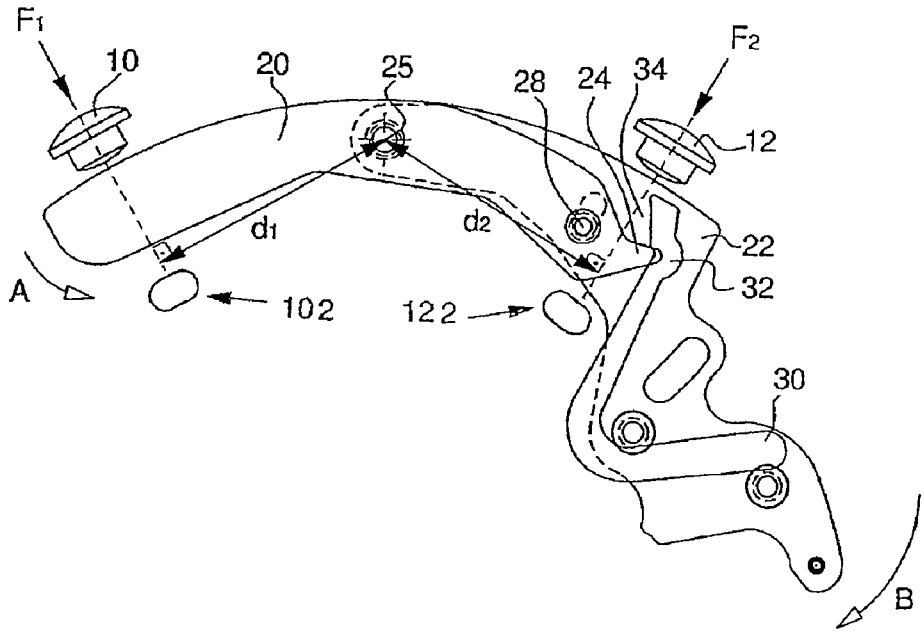
FIG. 3 shows a view of a chronograph control device, seen from the gear train side, according to another embodiment of the invention.

As illustrated in FIG. 1, the chronograph control device according to the first embodiment of the invention includes a first lever 20, pivotably mounted on a first pivot 25, activated by a first push-button 10, and a second lever 22, pivotably mounted on the same pivot 25, and activated by a second push-button 12. The movement of the two levers 20, 22 is limited in the direction of their respective push-buttons 10, 12, by a stop member 100, 120, respectively, which is not shown in FIG. 1 as a component separate from the corresponding push-buttons. While it is particularly advantageous, according to a preferred embodiment of the invention, that the first stop member 100 and/or the second stop member 120 is formed by a portion of the corresponding push-button 10, 12, it is within the scope of the present invention for the first stop member and the second stop member to be formed as components separate and distinct from the push-buttons 10, 12. FIG. 3 illustrates such an alternate embodiment, which includes a first stop member 102 and a second stop member 122, which are separate and distinct structures from the first push-button 10 and the second push-button 12, respectively. As evident from FIG. 3, the first stop member 102 is disposed to limit movement of the first lever 20 in the direction of the first push-button 10, and the second stop member 122 is disposed to limit movement of the second lever 22 in the direction of the second push-button 12.

To prevent the two push-buttons 10, 12 being activated simultaneously, the two levers 20, 22 are secured to each other via a pin 28, which can move in a longitudinal hole. The first lever 20 takes the form of reset lever and can control the motion, for example, of a conventional hammer stem-bolt, in order to release a hammer held by a spring. The second lever 22 starts and stops a chronograph counter. As the invention only concerns the control device, the actual chronograph mechanism will not be described in detail. However, according to the invention, the device can, in theory, be used with any type of timepiece mechanism, in particular a chronograph mechanism comprising column wheel or cam systems.

As can be seen in FIG. 1, a jumper spring 30 is mounted on the second lever 22 by means of two studs. The spring 30 is generally V-shaped with one arm immobile relative to the second lever 22 and a second arm located on the side of first lever 20. Further, in the end part of the arm on the side of the first lever, the spring 30 includes a notch or slot 32, which cooperates with a beak 24 attached to first lever 20. This beak 24 is held in the notch 32 by the return force of spring 30. When the first lever 20 is pivoted via the action of the first push-button 10 on pivot 25, in the direction of arrow A, the beak 24 attached to first lever 20 has to overcome the notch force holding it in notch 32 of spring 30. Once this force has been overcome, the user will feel the resistance decrease and will know that the desired reset has occurred. If the user continues to activate push-button 10, beak 24 is no longer in notch 32, but is sliding along the inclined plane 34 that forms the end of spring 30, while first lever 20 still resists the return force of spring 30. This inclined plane 34 ensures the return of lever 20, 22, when the user releases the push-button 10, 12.

The resistance that will be felt by a user, who presses on first push-button 10 in order to reset the chronograph counter mechanism, is thus proportional to the notch force that has to be overcome in order for beak 24 to leave notch 32 of the spring 30.

When the second lever 22 is pivoted via the action of second push-button 12 on the same pivot 25 in the direction of arrow B, it also resists the same notch force, determined by the geometry of spring 30 and by the return force thereof. However, in this case, the force is exerted by the movement of spring 30 and not by that of beak 24. As the resulting force is the same as when the first lever 20 pivots, the sensation of resistance when the first and second push-buttons 10, 12 are respectively activated depends only on the actual lever arm ratio in each case, as explained in more detail below.

The resistance that will be felt when the first push-button 10 is activated is inversely proportional to the distance $d_1$ between the pivoting axis 25 of first lever 20 and the direction $F_1$ of the force exerted on first push-button 10 when the latter is activated. Likewise, the resistance that will be felt when the second push-button 12 is activated is inversely proportional to the distance $d_2$ between the pivoting axis 25 of the second lever 22 and the direction $F_2$ of the force exerted on the second push-button 12 when the latter is activated. If one wishes the resistance to be the same for both push-buttons 10 and 12, the device illustrated in FIG. 1 must be sized such that distances $d_1$ and $d_2$ are equal. One could, of course, choose a desired ratio between distances $d_1$ and $d_2$, which is greater than or less than 1.

Figure 2:
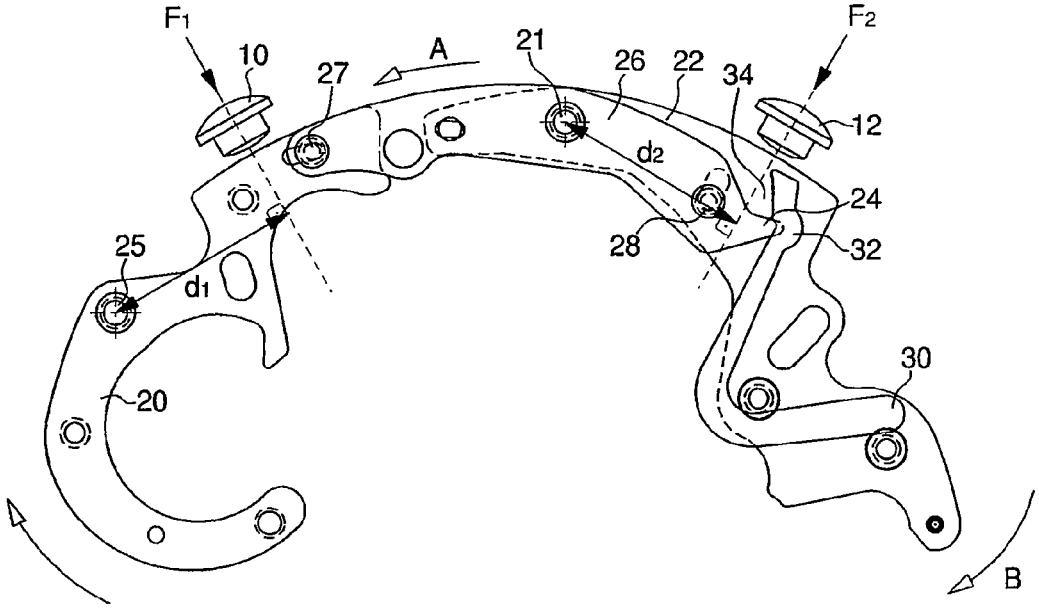
FIG. 2 shows a view of a chronograph control device, seen from the gear train side, according to a second embodiment of the invention.

FIG. 2 shows a chronograph control device according to a second embodiment. In this second embodiment, those elements that are identical to those described with reference to FIG. 1 will be designated by the same reference numerals. As in the first embodiment, the device includes a first lever 20, pivotably mounted on a first pivot 25, activated by a first push-button 10, and a second lever 22, pivotably mounted on a second pivot 21 and activated by a second push-button 12. The movement of the two levers 20, 22 is limited in the direction of their respective push-buttons 10, 12, by a stop member that is not shown. Unlike the first embodiment, the second embodiment includes a beak 24, which cooperates with notch 32 of spring 30. This beak 24 is no longer integral with first lever 20, but integral with an arm 26 articulated on first lever 20 at a place designated by the reference 27 in FIG. 2. This arm 26 is pivotably mounted on the same pivot 21 as the second lever 22, but it could also be pivotably mounted on a third pivot. In any case, the first lever 20 and second lever 22 pivot in the same direction B, whereas arm 26 pivots in the opposite direction A. Nonetheless, as in the embodiment illustrated in FIG. 1, the sensation of resistance when the first and second push-buttons 10, 12 are respectively activated, depends only upon the actual lever arm ratio in both cases and thus only on the geometry of the device. As in the first embodiment described above, the resistance that will be felt when one of the two push-buttons 10, 12 is activated, is inversely proportional to the distance $d_1$, $d_2$ between the pivoting axis of the associated lever 20, 22 and the direction $F_1$, $F_{12}$ of the force exerted on the push-button 10, 12 concerned when the push-button is activated. In order to size the device shown in FIG. 2 so that the resistance is the same for both push-buttons 10, 12, account must be taken not only of distances $d_1$ and $d_2$, but also of the distance between hinge 27 of arm 26 and the pivot 28 on which arm 26 and the second lever 22 are pivoting, and the position of the pivot 26 relative to spring 30 and beak 24.

What is claimed is:

1. A chronograph control device including:

(a) a first, pivotably mounted lever that is activated by a first push-button, and whose movement in a direction of the first push-button is limited by a first stop member;

(b) a second, pivotably mounted lever that is activated by a second push-button, and whose movement in a direction of the second push-button is limited by a second stop member; and (c) a spring mounted on the second lever, wherein the first lever is associated with an arm that cooperates with the spring so that, when one or other of the two levers is activated by one of the push-buttons, the arm and the spring move relative to each other so that the arm is subjected to a return force of the spring.

2. The chronograph control device according to claim 1, wherein the arm is provided with a beak that cooperates with the spring.

3. The chronograph control device according to claim 1, wherein the arm is provided with a pin or peg that cooperates with the spring.

4. The chronograph control device according to claim 1, wherein the arm is attached to the first lever and wherein said first lever pivots in an opposite direction of rotation to that of the second lever.

5. The chronograph control device according to claim 4, wherein a distance between the pivoting axis of the first lever and the direction of the force exerted on the first push-button when said push-button is activated, is equal to a distance between the pivoting axis of the second lever and the direction of the force exerted on the second push-button, when said push-button is activated.

6. The chronograph control device according to claim 1, wherein the arm is pivotably mounted and articulated on an end of the first lever, wherein said first lever pivots in the same direction of rotation as the second lever and the arm pivots in an opposite direction of rotation to the two levers.

7. The chronograph control lever according to claim 1, wherein the arm is articulated on the second lever and pivots about the same axis as said second lever.

8. The chronograph control device according to claim 1, wherein the spring is a jumper spring.

9. A chronograph mechanism comprising:

(a) a first stop member and a second stop member; and (b) a chronograph control device including i. a first, pivotably mounted lever that is activated by a first push-button, and whose movement in a direction of the first push-button is limited by the first stop member;

ii. a second, pivotably mounted lever that is activated by a second push-button, and whose movement in a direction of the second push-button is limited by the second stop member; and iii. a spring mounted on the second lever, wherein the first lever is associated with an arm that cooperates with the spring so that, when one or other of the two levers is activated by one of the push-buttons, the arm and the spring move relative to each other so that the arm is subjected to a return force of the spring.

* * * * *